US008567138B2

(12) United States Patent
Toledo

(10) Patent No.: US 8,567,138 B2
(45) **Date of Patent: *Oct. 29, 2013**

(54) SECURABLE COVER APPARATUS FOR TRADE SHOW BOOTHS

(75) Inventor: Dario Toledo, New York, NY (US)

(73) Assignee: Boothseal LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/562,270

(22) Filed: Sep. 18, 2009

(65) Prior Publication Data

US 2010/0107528 A1 May 6, 2010

Related U.S. Application Data

(63) Continuation of application No. 10/667,695, filed on Sep. 22, 2003, now Pat. No. 7,610,727.

(60) Provisional application No. 60/412,282, filed on Sep. 20, 2002.

(51) Int. Cl.
*E04B 1/00* (2006.01)

(52) U.S. Cl.
USPC ..... 52/222; 52/202; 52/3; 52/23; 135/114; 135/119; 160/135

(58) Field of Classification Search
USPC ..... 52/202, 222, 23, 3; 40/604, 617; 5/414, 5/504; 135/114, 128, 143, 151, 119, 901; 160/135, 351, 384, 377, 264
See application file for complete search history.

(56) References Cited

U.S. PATENT DOCUMENTS

| | | | | |
|---|---|---|---|---|
| 566,815 | A * | 9/1896 | Taylor | 160/327 |
| 2,255,837 | A * | 9/1941 | Volk | 135/97 |
| 3,750,739 | A * | 8/1973 | McGuire | 160/354 |
| 3,763,917 | A | 10/1973 | Antinone | |
| 4,100,957 | A | 7/1978 | Shelton | |

(Continued)

FOREIGN PATENT DOCUMENTS

| | | |
|---|---|---|
| DE | 03345255 | 7/1984 |
| DE | 9407179 | 7/1994 |

OTHER PUBLICATIONS

European Patent Office (EPO), Supplementary European Search Report, Sep. 21, 2011.

(Continued)

*Primary Examiner* — Chi Q Nguyen
(74) *Attorney, Agent, or Firm* — Gottlieb, Rackman & Reisman PC

(57) ABSTRACT

This invention relates to a security apparatus for trade show booths comprising a flexible cover section to enclose an opening in a booth structure and a means for securely fastening the edges of the cover section to an opening of a booth structure so as to provide a securable removable cover to deter individuals from stealing merchandise from a display booth or otherwise enclose the booth for privacy. In one embodiment, adjustable fasteners that are used to secure the vertical edges of the cover are provided in a manner that does not permit removal from outside of the cover when installed. Optional hangers are also used to hang the top edge of the cover to a support structure. Additionally, the cover may be provided with an adjustment belt to ensure that the cover remains taut on the support structure when locked in its fastened position.

15 Claims, 13 Drawing Sheets

(56) References Cited

U.S. PATENT DOCUMENTS

| | | | | |
|---|---|---|---|---|
| 4,102,353 | A * | 7/1978 | Pugliese | 52/16 |
| 4,218,104 | A * | 8/1980 | Anderson et al. | 312/406 |
| 4,941,763 | A * | 7/1990 | Euteneuer | 403/3 |
| 4,986,389 | A * | 1/1991 | Halligan et al. | 182/138 |
| 5,522,165 | A * | 6/1996 | Molla | 40/604 |
| 5,768,722 | A * | 6/1998 | Olson et al. | 5/9.1 |
| 6,176,050 | B1 * | 1/2001 | Gower | 52/222 |
| 6,325,085 | B1 * | 12/2001 | Gower | 135/90 |
| 7,337,582 | B1 * | 3/2008 | Klotz | 49/465 |
| 7,461,485 | B2 * | 12/2008 | Toledo | 52/222 |
| 7,610,727 | B2 * | 11/2009 | Toledo | 52/222 |
| 7,654,045 | B2 * | 2/2010 | Wiegel | 52/202 |
| 2002/0189660 | A1 | 12/2002 | Livacich | |
| 2005/0183761 | A1 | 8/2005 | Livacich | |
| 2011/0024059 | A1 | 2/2011 | Livacich | |

OTHER PUBLICATIONS

European Patent Office, Office Action, Mar. 27, 2012, Application No. 03 759 462.9-2303, Applicant—Boothseal LLC.

* cited by examiner

FIG. 2
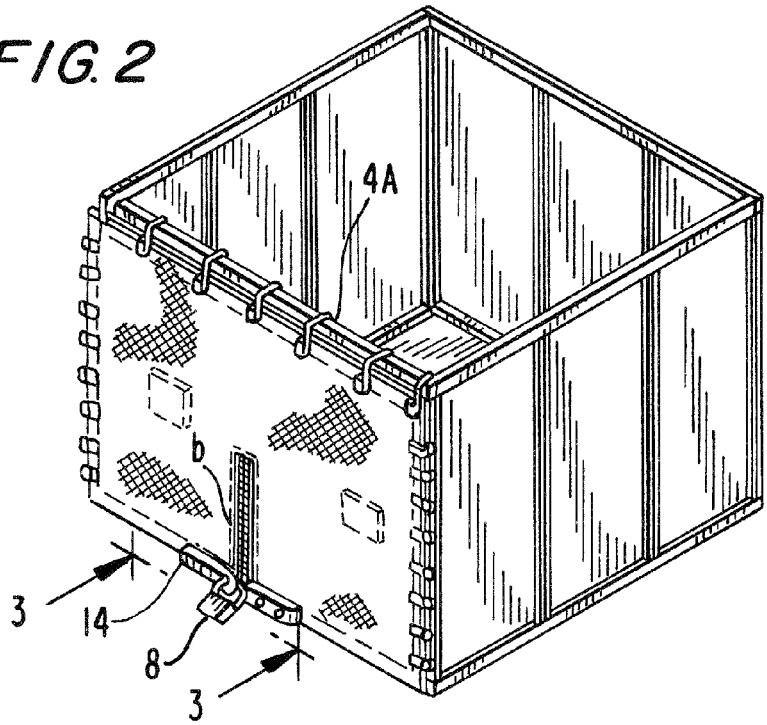
FIG. 3
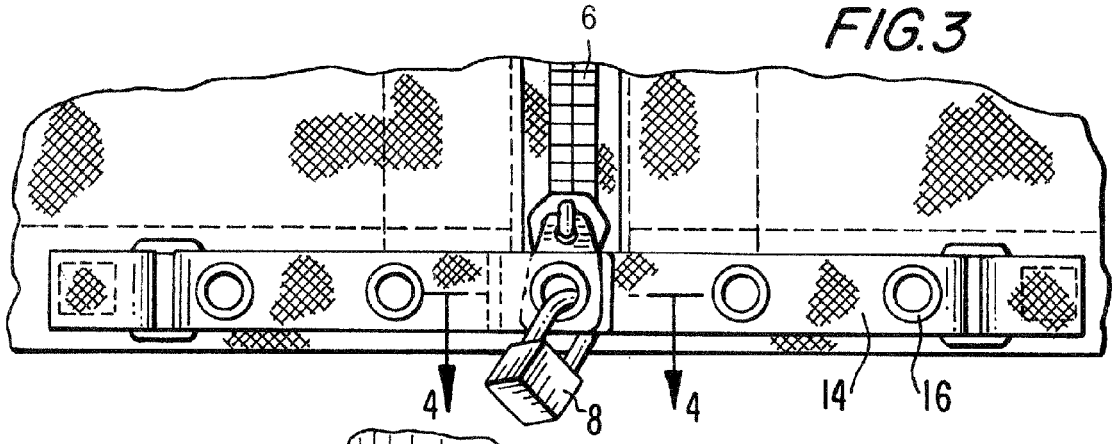
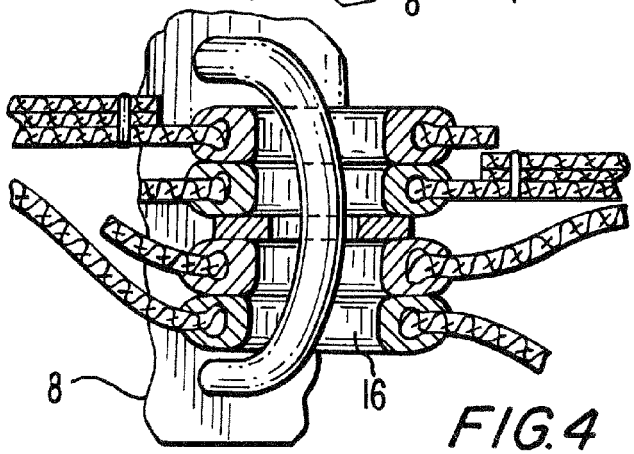
FIG. 4

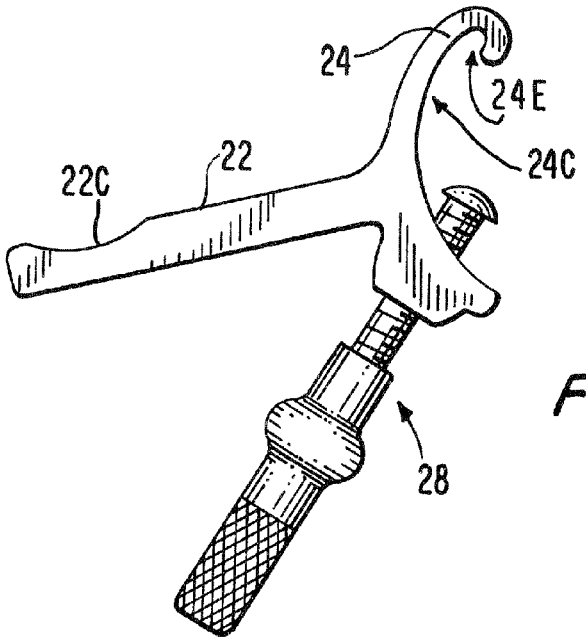
FIG. 16
FIG. 17
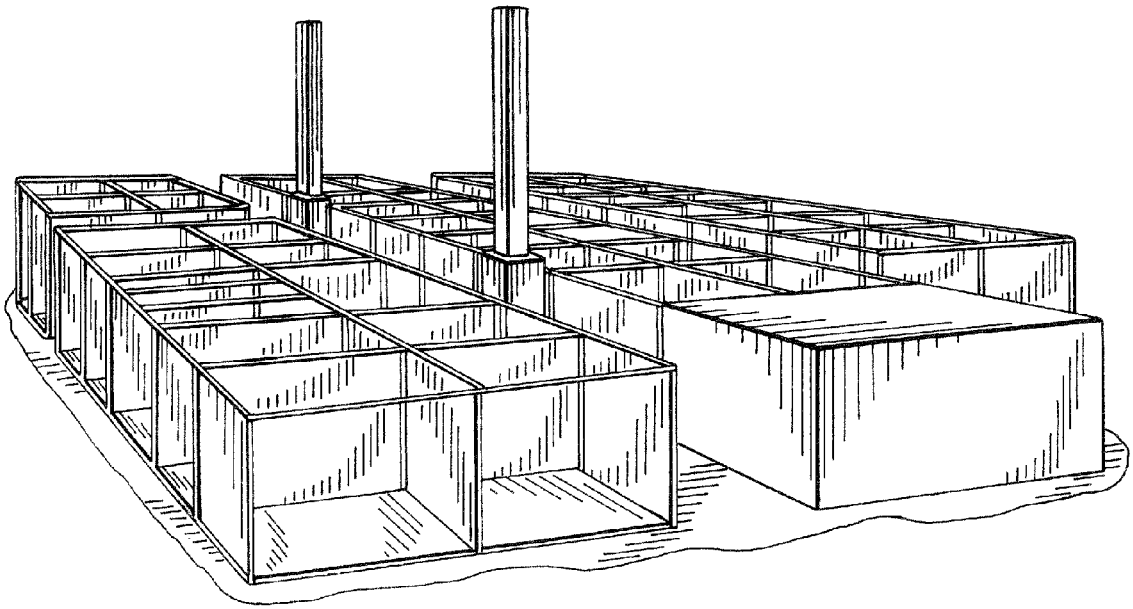

SECURABLE COVER APPARATUS FOR TRADE SHOW BOOTHS

RELATED APPLICATION

This application is a continuation of application Ser. No. 10/667,695, filed on Sep. 22, 2003, now U.S. Pat. No. 7,610,727 now allowed, which claims priority of U.S. provisional application Ser. No. 60/412,282 filed on Sep. 20, 2002, both of which are incorporated herein by reference.

FIELD OF INVENTION

This invention relates to systems for providing secure enclosures for temporary structures. More specifically, the invention involves an apparatus for providing a securable enclosure for temporary booths typically used at trade shows.

BACKGROUND OF INVENTION

The industry of organizing and operating trade show events is complicated by common concerns that patrons have for protecting their wares from being stolen. Typically, trade show booths have walls or partitions on all but one of its sides. One side is left open to maximize the presentation area for potential viewers during the trade show. While this opening is particularly useful during trade show hours, it can present a problem during the off hours.

During the off hours of a show, it is convenient for booth operators to keep their products and wares in the booths to avoid the repetition of having to set up for each day of the show. However, this poses certain risk. Due to the open nature of the booth, there is little protection for the products and wares from being stolen.

One potential solution to the problem is to restrict entry to the trade show venue. However, taking this action does not prevent those who need to enter from stealing merchandise from a patron's booth. Moreover, hiring security guards to protect each booth is not economical.

The prior art does not teach an acceptable apparatus for providing a secure enclosure in the context of trade show booths. For example, partition systems taught by Hegg et al. (U.S. Pat. No. 4,021,973), Gassier (U.S. Pat. No. 4,388,786), Jones (U.S. Pat. No. 4,493,172), and lzatt et al. (U.S. Pat. No. 5,816,000) could not adequately serve this purpose. While they generally teach partition systems that may be used to construct discrete spaces for use as office dividers or convention exhibition booths, these systems are not designed to provide removable openings that satisfy the needs of trade show booth operators. In short, they lack a design for coverage of spacious openings while simultaneously promoting easy installation, removal and compact storage.

BRIEF DESCRIPTION OF THE INVENTION

The principal objective of the present invention is to provide a booth enclosure apparatus to provide a level of protection for exhibitors' merchandise from theft when the exhibitor is not present and the booth is not being used.

A further objective of the present invention is to provide such an apparatus that is simple to install and simple to remove.

An additional objective is to provide such an apparatus that is compact to store when not in use.

Another objective is to provide a simple removable means for show exhibitors to obtain a level of privacy while setting up an exhibit in a booth or otherwise prevent others from observing the exhibit at certain times.

A still further objective is to provide such an apparatus that will be compatible with the booth structures commonly used at trade shows.

Additional objectives will be apparent to those skilled in the art from the description of the invention as contained herein.

In its broadest aspects, the invention is a booth enclosure apparatus. The apparatus utilizes a flexible cover section to enclose an opening in a booth structure and a means for securely fastening the edges of the cover section to an opening of a booth structure so as to provide a lockable, removable cover to deter individuals from stealing merchandise from a display booth or otherwise enclose the booth for privacy.

Optionally, a lockable opening in the cover provides restricted access to the inside of the booth useful for removal and installation of the enclosure apparatus. In one embodiment, adjustable fasteners are provided with a structure to secure the vertical edges of the cover to side support posts of the booth structure in a manner that does not permit removal from outside of the cover when installed. Optional hooks or hangers are used to hang the top edge of the cover to a top horizontal cross bar support. The cover may be provided with an adjustment belt to ensure that the cover remains taut on the support structure when locked in its fastened position.

BRIEF DESCRIPTION OF THE DRAWINGS

FIG. 2 illustrates the booth of FIG. 1 with an embodiment of the invention attached thereto;

FIG. 3 depicts a partial view of one embodiment of a lockable zippered portion from an opening in an enclosure apparatus of the invention along lines 3-3 of FIG. 2;

FIG. 4 depicts a cross sectional view of the lock portion taken along line 4-4 of FIG. 3;

FIG. 16 depicts a further embodiment of a fastener of the invention;

FIG. 17 depicts several booths in a trade show;

DETAILED DESCRIPTION OF THE INVENTION

The invention is an apparatus for providing a level of protection for trade show booths in the form of a removable closure apparatus. The apparatus includes a flexible cover 2 to enclose an opening in a booth structure and a means for securely fastening the cover 2 to a support structure of the booth. With the invention a lockable, removable cover can deter individuals from stealing merchandise from a display booth and can be compactly stored.

Figure 1:
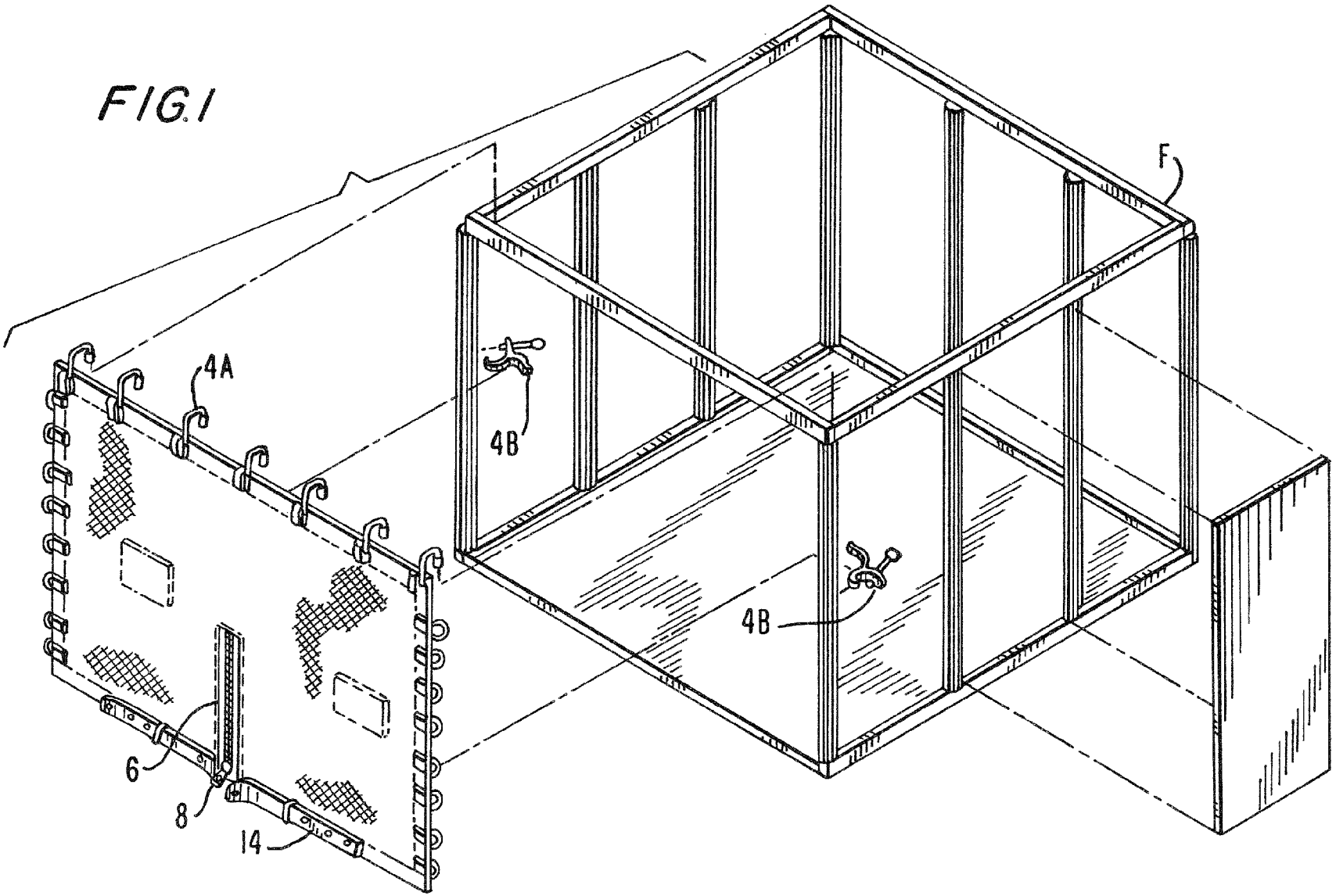
FIG. 1 depicts a typical booth support structure and an embodiment of the invention separated from the booth.

Referring to the drawings, FIG. 1 depicts a typical support structure or frame F of a trade show booth that may be used at trade shows. Normally, three of the four sides of the booth are fixed firmly by attaching temporary hard walls or partitions along support poles that have channels running the length of the pole. One or more presentation sides may be left open to maximize the display area during the tradeshow hours. For protection after show hours, the apparatus includes a cover 2 and means for securely fastening the cover 2 to the frame F. Optionally, a lockable opening 6 in the cover 2 is provided. In FIG. 1, the cover 2 is shown in an unfastened position. FIG. 2 depicts the cover 2 in a fastened position on the frame F.

The cover 2 is sized to cover a presentation area of the frame F of a booth but flexible to be compactly stored when removed. The cover 2 is rectangular in shape to accommodate typical booths. If too large a cover is used, no level of protection can be achieved since a loose cover can be easily circumvented. Thus, a rectangular section of material of appropriate size is of a width in a range of about 110 to 120 inches, preferably about 116, and a height in a range of about 85 to 105 inches, preferably about 94. The cover 2 includes a section of material or tarpaulin and may be formed of canvas, fabric, heavy plastic, synthetic polyester, Kevlar or other appropriate material. The preferred material is durable, not easy to tear or otherwise breach so that a level of security can be obtained. The material may also be provided as a fire retardant fabric to satisfy any applicable fire codes pertinent to the location of use. With stronger materials greater protection can be achieved to protect the contents of the booth, for example, by making the cover from Kevlar, which would be resistant to cutting by sharp objects such as a knife. The material may be transparent but opaque material is favored so that the contents of a booth will not attract undesired attention. Preferably, the cover also does not have an incorporated frame such that it has no independent rigid structure. This promotes ease of assembly and storage so that it may fold compactly when removed from the frame of the booth.

A lockable access opening 6 in the cover 2 provides restricted access to the inside of the booth for removal and installation of the enclosure apparatus. Provision of such an opening is particularly appropriate where the means for securing the cover 2 to the frame F are only removable from the inside of a booth when the cover 2 is in the fastened position. Such fasteners are described in more detail herein. The access opening 6 may also serve to simplify authorized entry into a booth without the need for removing the cover 2 from the frame F. As shown in the embodiments of FIGS. 1, 2 and 3, there is provided a lockable zippered access opening 6 within the cover 2. Typically, after the cover 2 is in the fastened position, a user may unzip the access opening 6, exit, close the zipper and then attach a lock 8 to the bottom of the zipper. While the disclosed embodiments show a zippered access opening 6, it should be understood that other lockable openings can be utilized to practice the invention.

As previously mentioned, the cover 2 requires a means for securing it to the frame. The means for securely fastening should promote secure but easy removal such that it inhibits unauthorized users from removing the cover, but is also easy for the booth occupant to apply and remove. To this end, different types of hooks, hangers, fasteners or attachment members 4, 20 may be used with the invention. In addition, in one embodiment, the means for securing is permanently fixed to the cover 2 for ease of use or they may optionally be removable from the cover when they are not securing the cover 2 to the support frame F.

Figure 5:
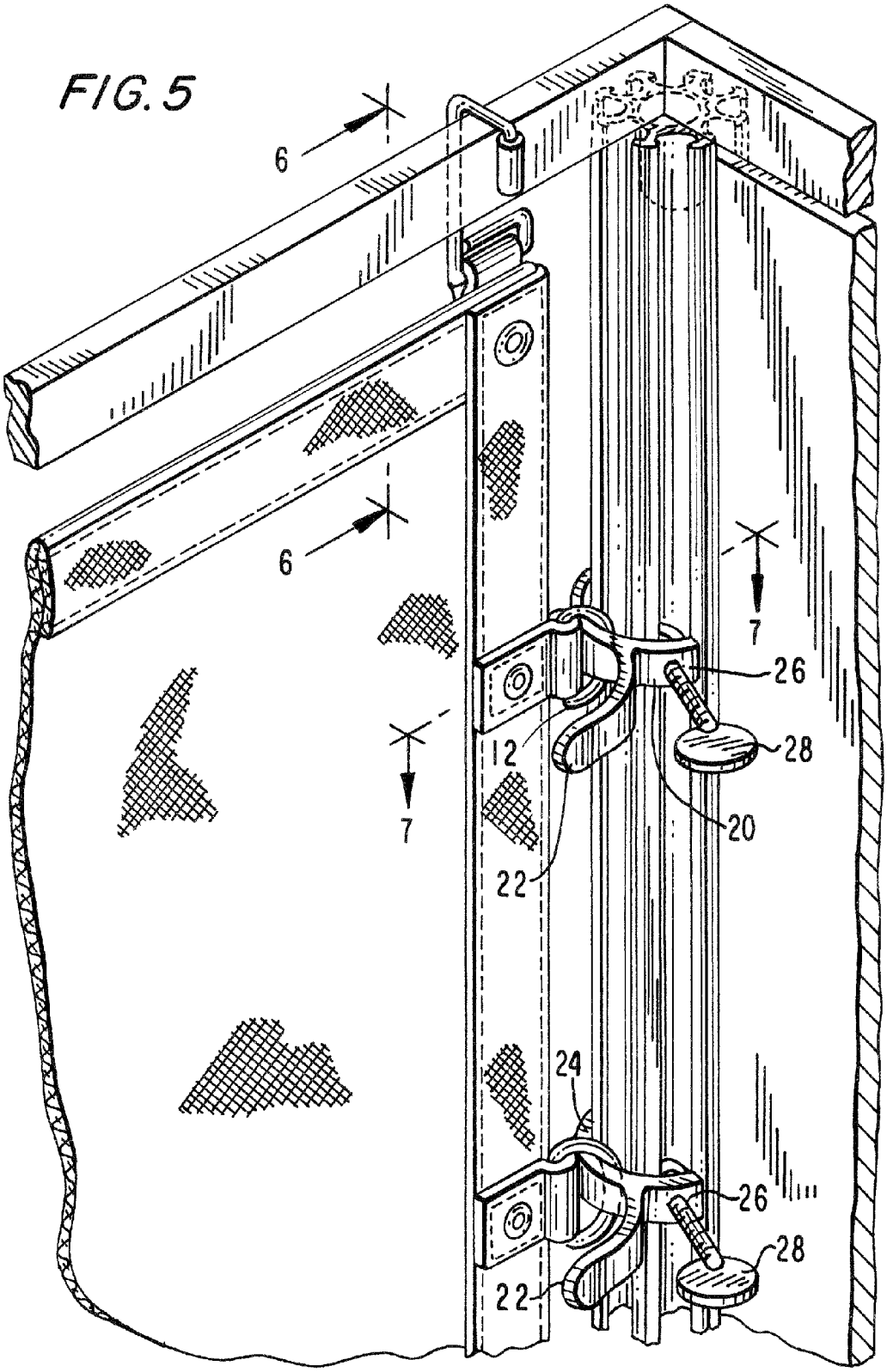
FIG. 5 depicts an interior view of a portion of a cover of the invention attached to booth support structure.
Figure 6:
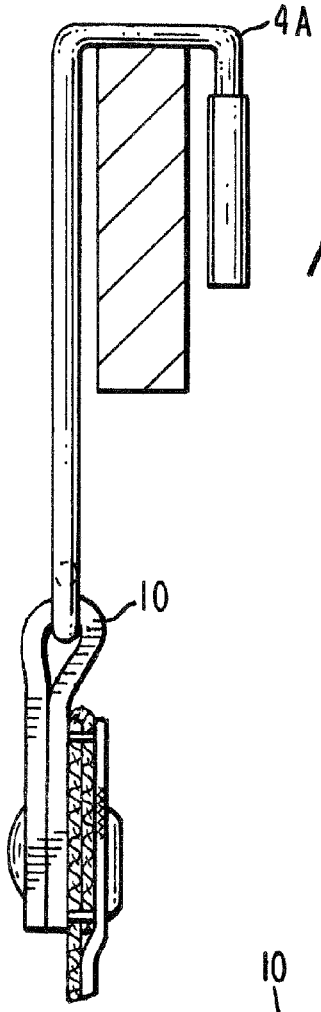
FIG. 6 depicts one embodiment of a fastener engaging a horizontal top booth support structure.
Figure 7:
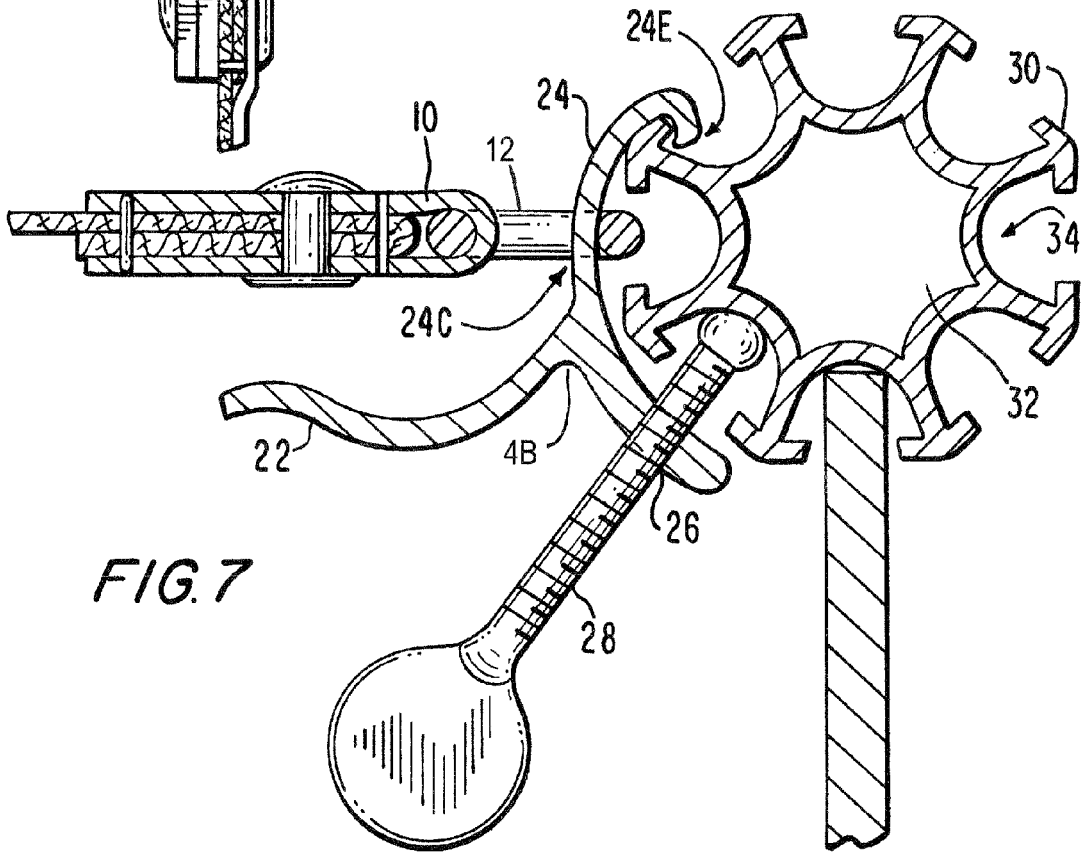
FIG. 7 is a plan view cross-section of another fastener engaging a vertical booth support structure.
Figure 8:
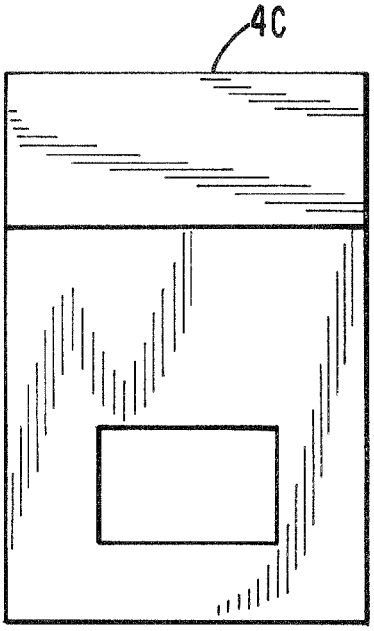
FIGS. 8-10 show an alternative embodiment of a fastener of the invention.
Figure 9:
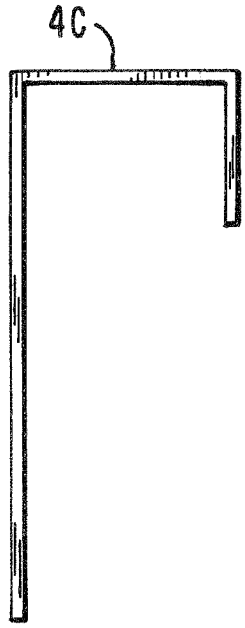
Figure 10:
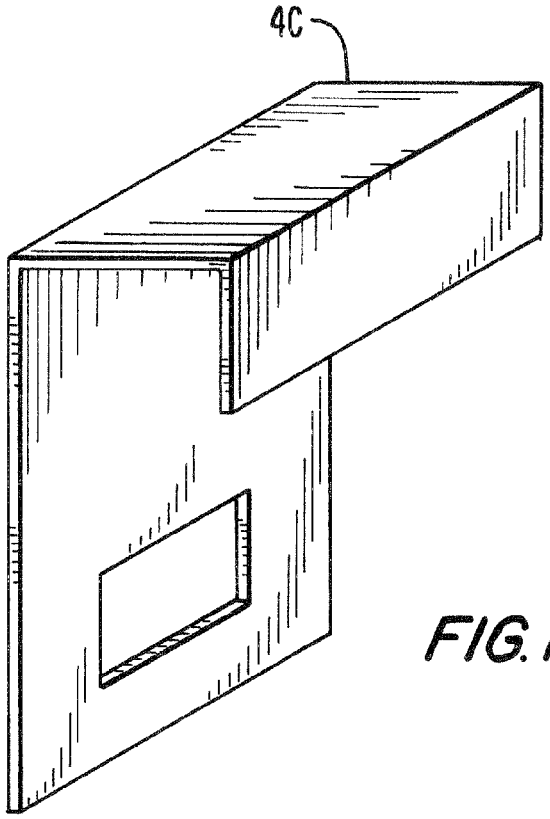

In one embodiment, as shown in FIGS. 5, 6 and 7, along the edges of the cover 2, straps create loops 10. The loops 10 may be attached to the cover a distance in from the perimeter edge of the cover 2 so that the outer edge of the loop 10 coincides or is no further than the perimeter edge of the cover 2. By such a design, when installed on a frame, the space between the frame and perimeter edge of the cover 2 is minimized to impede physical or visual access to the booth.

Figure 11:
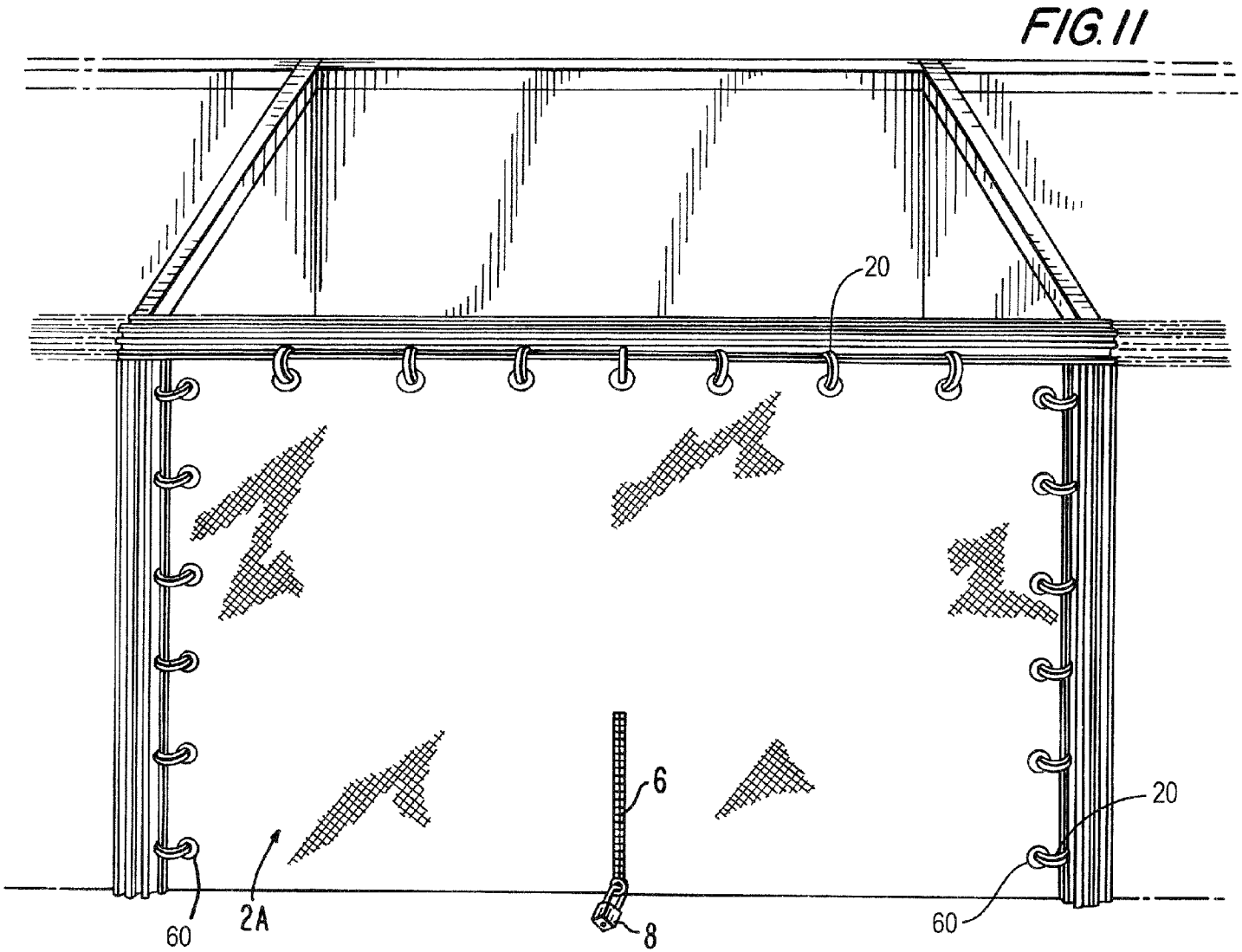
FIG. 11 depicts a booth with an alternative embodiment of the cover apparatus of the invention.
Figure 12:
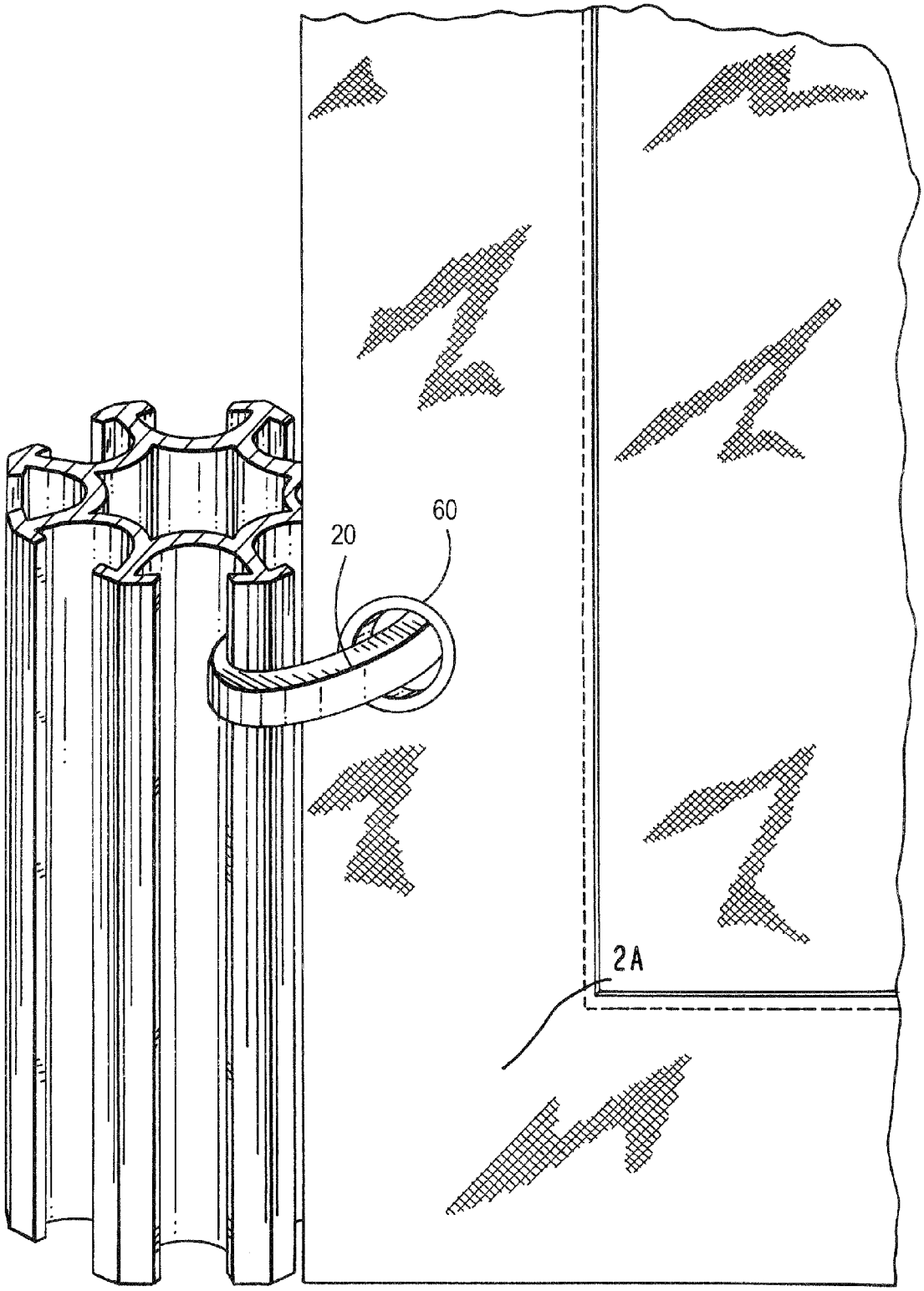
FIG. 12 depicts another embodiment of a fastener of the invention.

The loops 10 are also designed for coupling to attachment members for connecting the cover 2 to the support frame F the booth. These loops 10 can be permanently attached (i.e., grommet, stamped, sewn etc.) or temporarily attached (i.e. snaps on one end of the loop) at different edges of the cover depending on the need for a secure coupling. For example, the vertical edges should be secured so the loop 10 is permanent or not easily removable. For convenience, the loops 10 along the horizontal top edge may be temporarily attached with snaps. Leather or other durable material may be used to form each strap. As an alternative to providing such loops 10, grommets 60, as shown in FIGS. 11 and 12, may be applied to the edges of the cover 2A to serve a purpose of the loops 10.

In this embodiment, along the top horizontal edge that connects with a top horizontal cross bar of the booth frame F, the cover 2 is attached by hooks 4A or hangers 4C, 4D, 4E. One example of a hook is shown in FIG. 6 and examples of hangers are shown in FIGS. 8-10 and FIGS. 23 and 24. Alternatively, the hooks 4A or hangers 4C, 4D, 4E can easily be constructed to be permanently or temporarily attached to the cover 2 with or without the use of straps. The hooks 4A or hangers 4C, 4D, 4E are not tightened to the frame F but merely hang thereon. This promotes ease in attaching and removing the cover 2. The hooks 4A or hangers 4C, 4D, 4E also permit the cover 2 to be moved by sliding along the cross bar. Hooks 4A or hangers 4C, 4D, 4E used in this fashion may be used along the top edge without any increased security risk if more permanent fasteners secure the sides of the cover 2.

Figure 23:
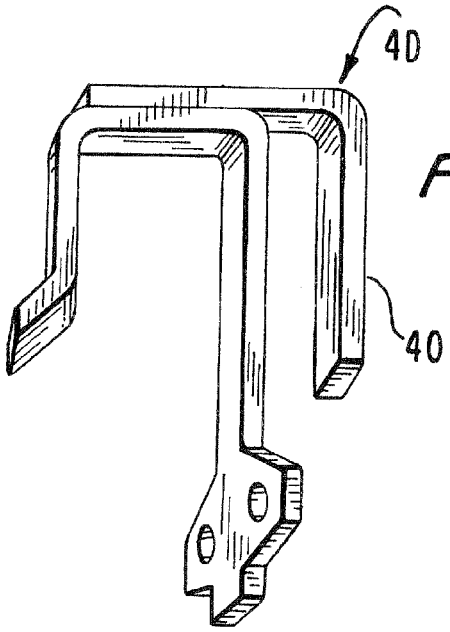
FIG. 23 depicts another embodiment of a fastener of the invention; with an installation extension.
Figure 24:
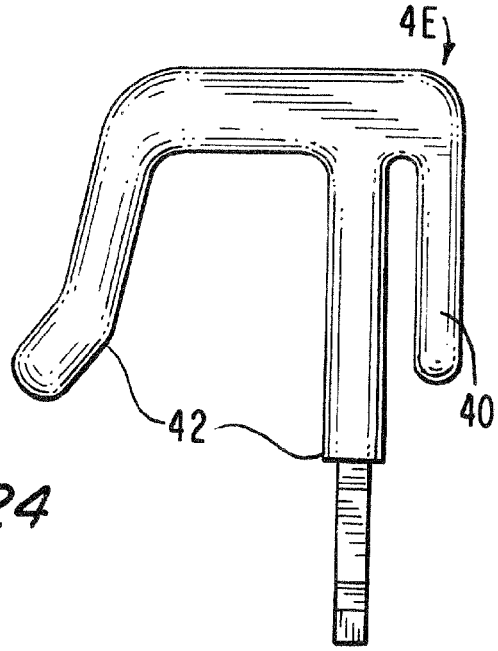
FIG. 24 depicts the embodiment of the fastener of FIG. 23 with a protective casing.

Since the cross bar upon which the hooks 4A or hangers 4C, 4D, 4E are suspended is generally elevated beyond a typical user's reach, there is provided on hangers 4D, 4E an installation extension 40 opposite the hanging portion, as shown in FIGS. 23 and 24, whereby a user may simply use an application pole or lifting device to easily lift hangers 4D, 4E onto or off of the cross bar without the use of an elevated surface such as a chair. The application pole is constructed with an engaging end that corresponds to the shape of the installation extension 40. Accordingly, the engaging end of the application pole forms a cylindrical structure, U-shaped end or other shaped structure that engages the installation extension 40 and lift hangers 4D, 4E onto or off of the cross bar. Use of the application pole and installation extension helps prevent injuries to all persons who would otherwise use an unsteady elevated surface or ladder. It also aids all users, especially those with physical impairments, from overly exerting themselves in the course of using the apparatus. The installation extension 40 and hanger 4D, 4E can be constructed or molded as a unitary structure as well as separate structures which are then fused or attached together. In this embodiment, hanger 4E may also be provided with a protective casing 42 such as a rubber cover to prevent damage or scratching to the hanger or the cross bar. Obviously, other appropriate forms of hangers and hooks can be used as well in conjunction with this invention.

In one embodiment of the invention, for fastening the vertical edges of the cover, a securable fastener 4B is used, as shown in more detail in FIG. 7. Other embodiments of securable fasteners 4B, 20, which are preferably used to fasten the vertical edges of the cover, are shown in FIGS. 11-14, 16 and 18-22. To couple with the fastener 4B, rings 12 are installed in the loops 10. The devices are made from a rigid and durable material such as a metal or alloy. Generally, the securable fastener 4B includes a handle portion 22. The securable fastener 4B also includes a hooked portion 24 for grasping an edge of the support frame F and holding a ring 10. In addition, the securable fastener 4B has a tightening member 28 at another end of the fastener 26 that when combined with the hooked portion 24 holds the fastener 4B to the frame F. Optionally, the securable fastener 4B itself may be fixed to the cover 2 by one or more rivets 50 through both the fastener and the cover 2 to prevent its easy removal from the cover 2. This embodiment, as illustrated in FIGS. 18-22, does not make use of a ring. Obviously, other appropriate forms of fasteners may also be used as well in conjunction with this invention.

The handle portion 22 promotes easy manipulation of the fastener 4B, 20. It is configured so that it can be comfortably gripped between two fingers while applying or removing the fastener 4B, 20 from the frame. Thus, it angles away from the hooked portion 24, the tightening member 28 and the booth structure when installed. In this regard, the handle portion 22 may be curved as shown in the embodiment of FIG. 7 or as shown in the embodiments of FIGS. 13-14 and 19-22, or it may be cylindrical with a finger score 22C as shown in FIG. 16.

The hooked portion 24 includes a curvature 24C for attachment to a ring 11 and a hook end 24E to grasp the edge of the Frame F. The curvature and length of the structure is particularly designed for connection with frame F depicted in FIG. 7 typical of the support structures used to construct trade show exhibit booths. As shown in FIG. 7, the support structure has a central opening 32 and a group of arc-shaped openings 34 around the periphery of the core and extensions 30 that define a perimeter around the periphery of the core. These poles serve a dual purpose of connecting walls or partitions around non-presentation sides of a booth. As designed, the fastener 4B by the hook end 24E grips onto an open channel of the pole core while the tightening member 28 projects into a second channel to attach the fastener 4B to the frame pole.

Figure 13:
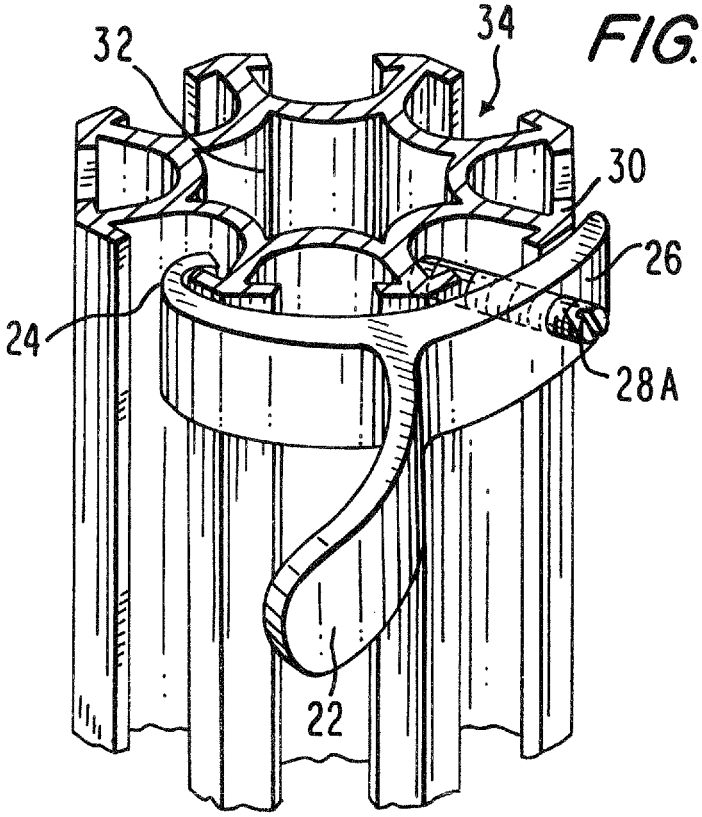
FIG. 13 is a cross sectional view of the fastener of FIG. 12.
Figure 14:
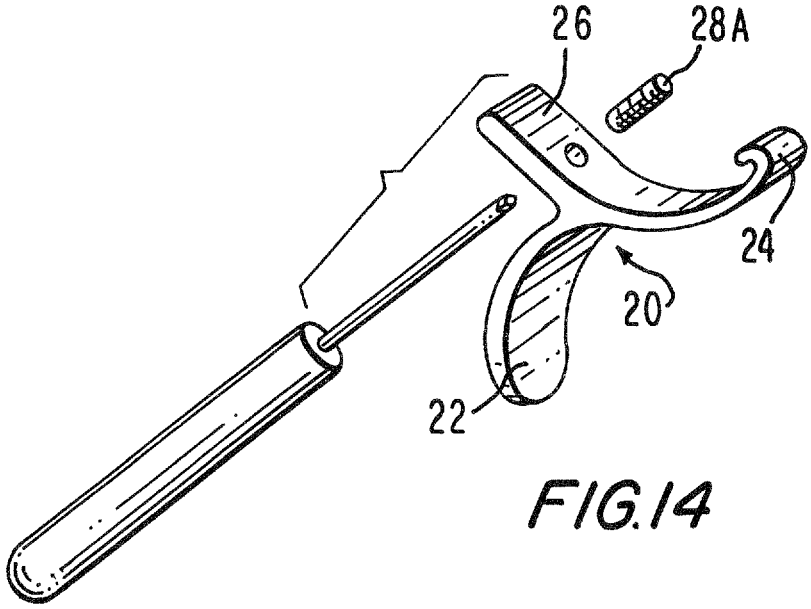
FIG. 14 is an elevational view of the fastener of FIG. 12.
Figure 15:
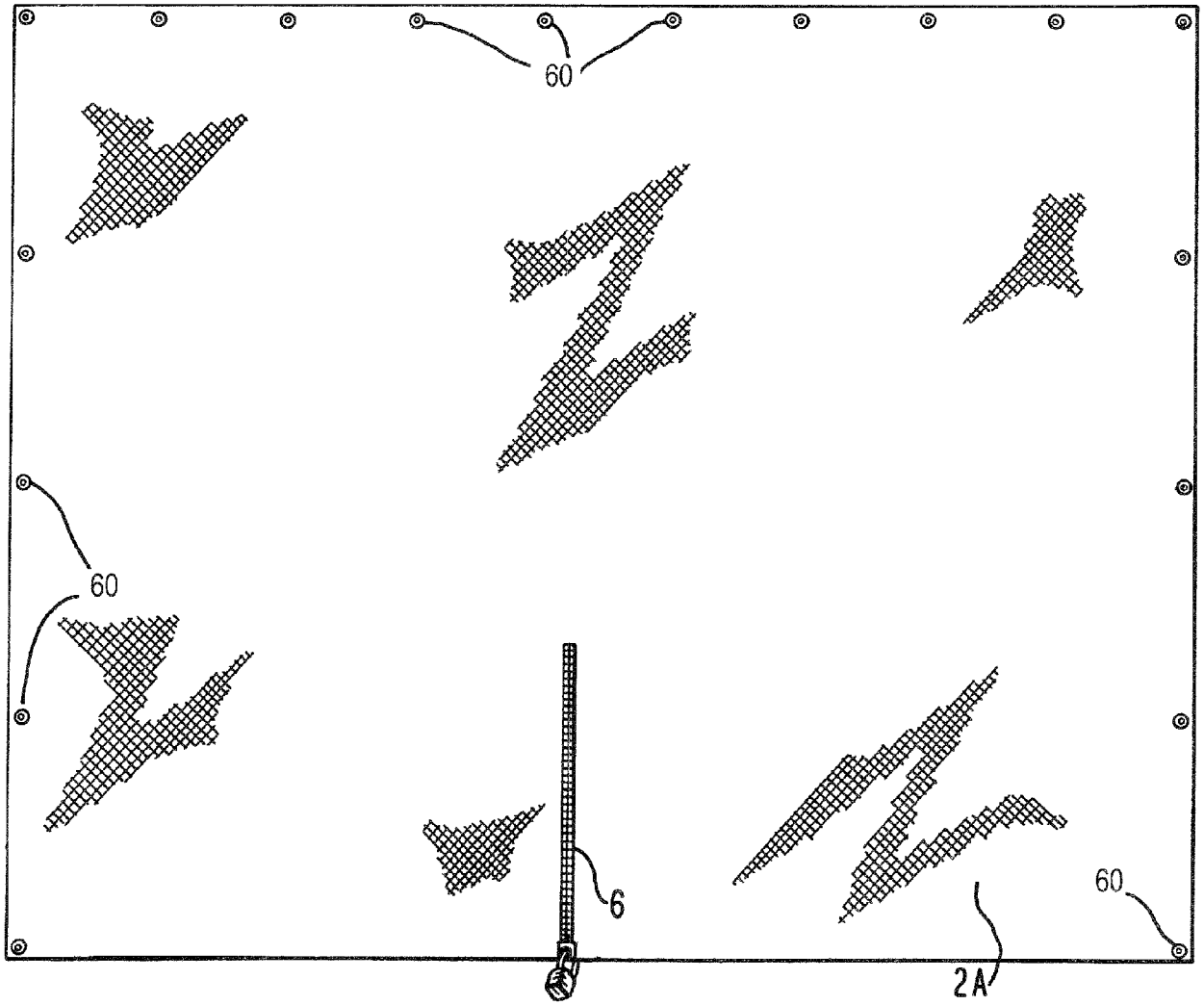
FIG. 15 is a front view of the cover apparatus of FIG. 11.
Figure 19:
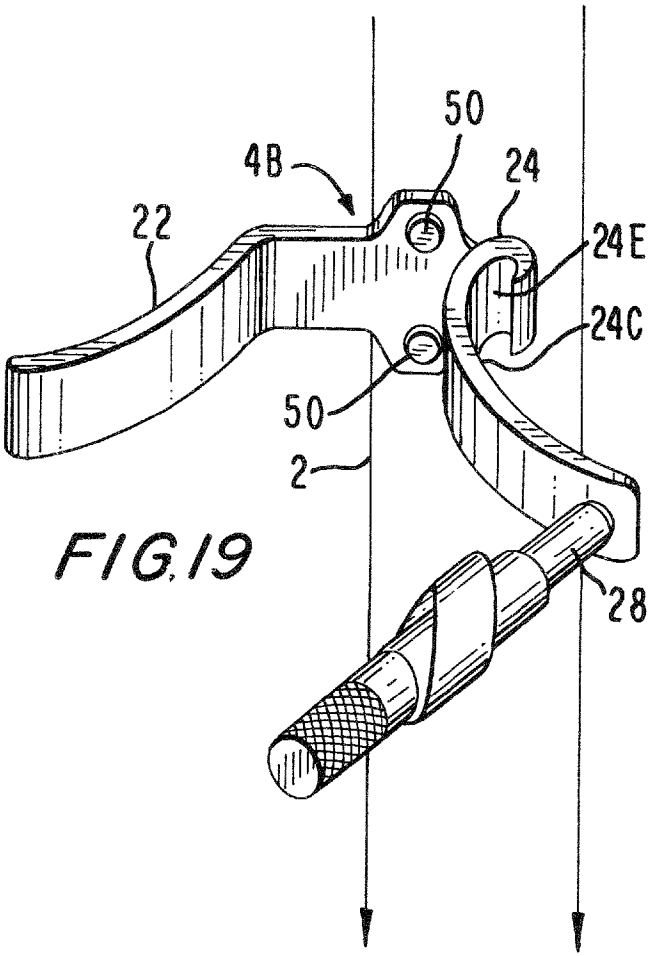
FIGS. 19-22 depict additional embodiments of a fastener of the invention.
Figure 18:
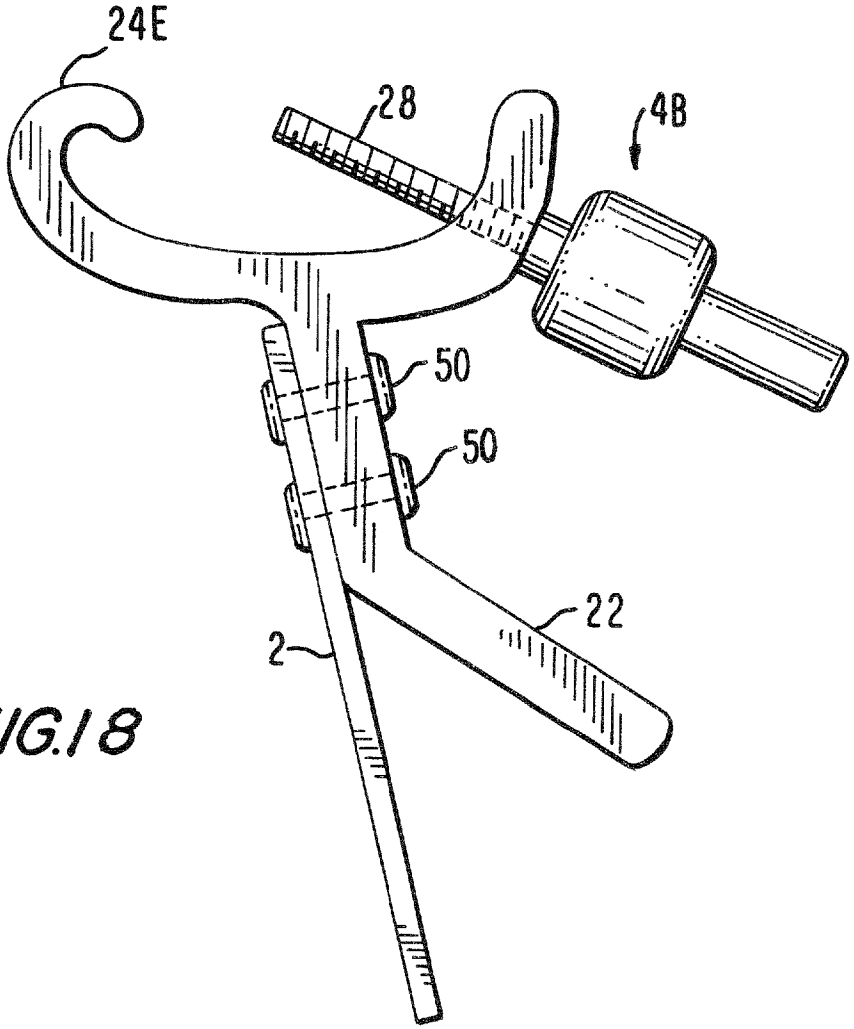
FIG. 18 depicts a side plan view of another embodiment of a fastener of the invention fixed to the cover, a portion of which is shown by cross-section.
Figure 20:
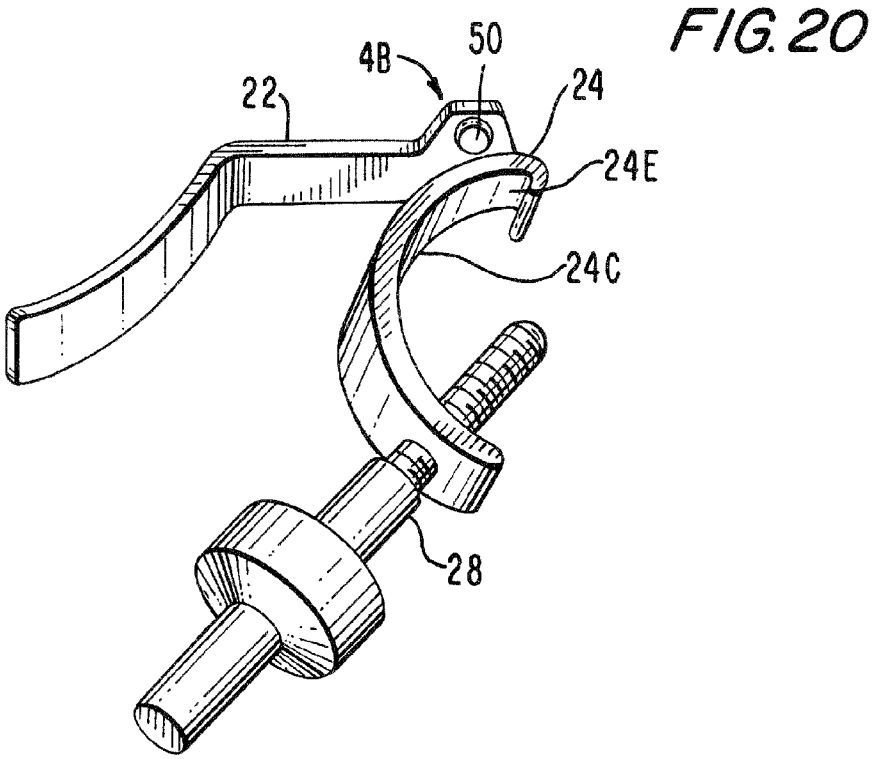
Figure 21:
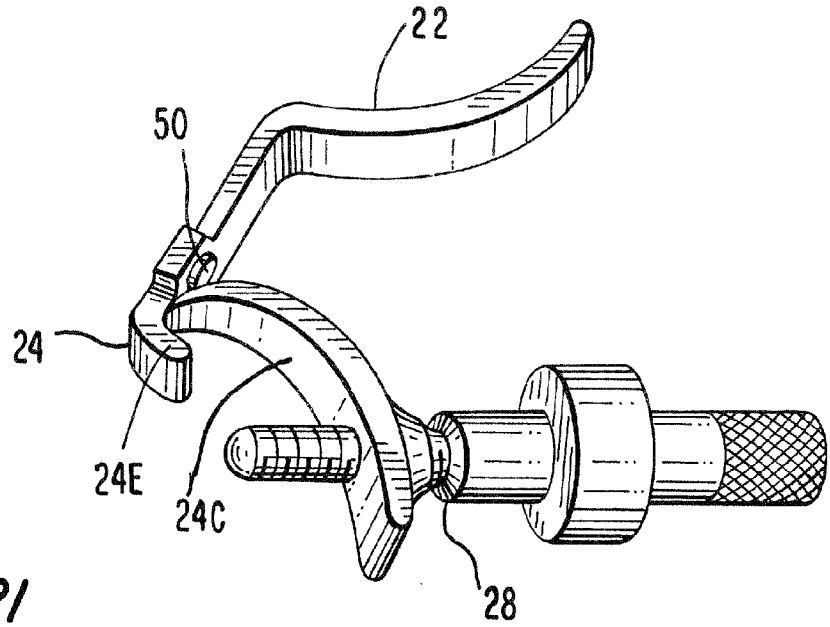
Figure 22:
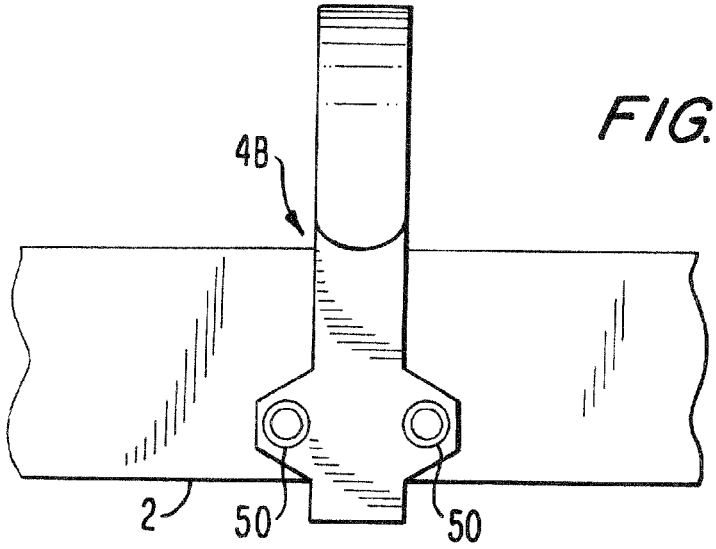

The tightening member 28 serves a securing purpose when tightened by protruding into the frame F reducing the distance between to the hook end 24E and the tightening member 28. The tightening member 28 has threads to match the threads in an aperture of the hooked portion 24. The tightening member 28 is preferably supplied with finger holds of various shapes and configurations for manual application to increase the torque of the user in tightening the threads and/or textured grooves or similar construction to improve grip. Optionally, as shown in FIGS. 13 and 14, the tightening member 28A may be supplied with a tool end such as a hex head, Phillips head or other bolt head for use with an automated device such as a drill with an appropriate tool insert. Like that of the handle, the tightening member is angled away from the handle portion 22 and the booth structure when installed to promote easy manipulation for installation or removal.

It is noted that in the designs described herein as illustrated in the drawings, use of the fastener 4B, 20 is not itself lockable but when combined with the cover 2, the fasteners are secure since the design of the fastener is such that it is removable from only one side of the cover as illustrated in FIGS. 5 and 7. When the handle portion 22 and tightening member 28 are internal to the booth structure and the hook end 24E is external to the booth structure relative to the cover 2, the cover 2 prevents the fastener 4B, 20 from being removed. By then locking an access opening 6 previously discussed, the cover 2 will provide a level of protection from access to the booth. Although fasteners may themselves be supplied in a lockable form to secure the cover 2 by installation from an exterior side of the cover 2 of the booth, the apparatus comprising non-locking fasteners has particular advantages over other locking fastener structures because it is simpler to use.

Optionally, fasteners may be used to secure the bottom edge of the cover as well. However, if the cover is properly sized and taut across the frame F they are not necessary. To assist in this purpose, an optional adjustment belt 14 is supplied on the cover 2. An adjustment belt 14 is shown in FIGS. 1 and 2 and in greater detail in FIGS. 3 and 4 along the bottom edge of the cover 2. Two separate lengths of the adjustment belt 14 are each fixed on opposing portions of the cover 2. As loose ends of the adjustment belt 14 are drawn together it eliminates excess slack in the cover 2 that may be present because of minor differences between the dimensions of the cover 2 and the space between support structures. The loose ends of the adjustment belt 14 are supplied with grommets 16 for receiving a lock 8. The grommets 16 of the adjustment belt 14 may be positioned proximate to the access opening 6 when included in the invention for locking therewith. In this way a common lock can secure the adjustment belt 14 and the access opening 6.

In use, the embodiments of the invention discussed herein provide an apparatus that appropriately addresses the problem experienced by tradeshow exhibitors and booth operators. It can also provide some privacy when the exhibitor is setting up an exhibit before or between shows. In order to install, the flexible cover 2 is unfolded. With the hangers 4C, 4D, 4E or hooks 4A at the top horizontal edge of the cover 2 resting on a horizontal cross bar on the booth, the cover 2 is extended across a presentation side of the booth. When fasteners 4B, 20 are not applied to the cover 2 with rivets 50, the fasteners 4B, 20 are then inserted through rings 12 at the curvature 24C or ring portion of the loops 10 at the side vertical edges of the cover 2. From the inside of the booth, while gripping the handle portion 22 of the fasteners 4B, 20, the hook end 24E is extended to grasp an edge of a channel of a frame F post. The tightening member 28, 28A is then applied to another channel of the post until tight. When all of the fasteners 4B, 20 are so applied to the booth's support posts, the booth is exited through the access opening 6. The access opening 6 is then closed and the adjustment belt 14 is drawn together. Both are then secured by a lock 8. Of course, full presentation access to the booth may be accomplished by removing the lock 8, entering the access opening 6 and removing the fasteners 4B, 20. The cover 2 may then be removed from the top horizontal cross bar by lifting the hangers 4C, 4D, 4E or hooks 4A from the cross bar and compactly folding the cover. Alternatively, the cover 2 can be compactly tied back at one side of the booth by sliding the cover 2 on the hangers 4C, 4D, 4E or hooks 4A while leaving them on the cross bar.

Although the invention is described in terms of particular embodiments, it is to be understood that the embodiments are merely illustrative of an application of the principles of the invention. Numerous modifications may be made and other arrangements may be devised without departing from the spirit and scope of the invention.

I claim:

1. A security system for securing a tradeshow booth comprising:

a flexible panel for covering the entrance to said tradeshow booth, said flexible panel having lateral edges, a top edge, a bottom edge, an exterior surface facing outside of said tradeshow booth and an interior surface facing inside of said tradeshow booth;

a vertical support structure having a channel;

a horizontal support structure;

a plurality of fastening members at said interior surface of said flexible panel, said fastening members each having at least one flange and at least one tightening member, said at least on flange and said at least one tightening member adapted to engage said vertical support structure; and a plurality of hanging members at said top edge of said flexible panel, each of said hanging members adapted to engage said horizontal support structure of said tradeshow booth;

wherein said at least one flange is adapted to engage said channel of said vertical support structure;

wherein when said security system is engaged, said at least one tightening member is positioned inside of said tradeshow booth; and wherein said plurality of hanging members each comprises a projection having an end, said end adapted for removable connection to a lifting device.

2. The security system of claim 1 further comprising an opening in said flexible panel for entering and exiting said tradeshow booth.

3. The security system of claim 1, said fastening member further comprising a handle portion.

4. The security system of claim 3, wherein said handle portion is curved and adapted to be held when said fastening member is engaged to said vertical support structure of said tradeshow booth.

5. The security system of claim 1, wherein said at least one tightening member is adapted to rotatably engage said vertical support structure of said tradeshow booth.

6. A security system for securing a space defined by a channeled support structure comprising:

a flexible section of material having at least two lateral edges and a top edge;

a channeled support structure having a first channel and a second channel;

a horizontal support structure;

a plurality of fastening members adapted to be secured to said flexible section of material at said at least two lateral edges, said fastening members comprising a flanged portion adapted to engage said channeled support structure at said first channel, and a tightening member adapted to engage said channeled support structures at said second channel; and a plurality of hanging members at said to edge of said flexible section of material, said hanging members connected to said horizontal support structure;

wherein said plurality of hanging members each comprise a projection having an end, said end adapted for moveable connection to a lifting device.

7. The security system of claim 6, further comprising an opening in said flexible section of material for entering and exiting said space.

8. The security system of claim 6, said fastening members comprising a handle portion.

9. The security system of claim 8, wherein said handle portion is curved and adapted to be held when said fastening member is engaged to said channeled support structure.

10. The security system of claim 6, wherein said at least one tightening member is adapted to rotatably engage said at least one channel of said channeled support structure.

11. A security system for securing a space defined by a channeled support structure, comprising:

a flexible section of material having at least two lateral edges, a top edge, a bottom edge and a lockable opening in said flexible section of material extending upward from said bottom edge;

a channeled support structure having a plurality of vertical supports and a horizontal support;

a plurality of fastening members adapted to be secured to said flexible section of material at said at least two lateral edges, each of said fastening members comprising a hooked portion adapted to engage an interior of said channeled support structure, a tightening member adapted to engage said interior of said channeled support structure, and a handle portion that is exposed and positioned apart from said hooking portion for gripping said fastening member; and a plurality of hanging members at said top edge of said section of material, said hanging members adapted to engage said horizontal support wherein said plurality of hanging members each comprise a hooked first end and a projection having a second end, said second end adapted for removable connection to a lifting device.

12. The security system of claim 11, wherein said tightening member is adapted to rotatably engage said interior of said channeled support structure.

13. The security system of claim 11, wherein when said security system is engaged, said tightening member is positioned entirely inside said space defined by said channeled support structure.

14. The security system of claim 11, further comprising a plurality of pairing members, wherein said fastening members are secured to said flexible section of material by said pairing members.

15. The security system of claim 14, wherein said pairing members are rivets.

* * * * *